US006581808B2

(12) United States Patent
De Laforcade

(10) Patent No.: US 6,581,808 B2
(45) Date of Patent: Jun. 24, 2003

(54) CAP FOR DISPENSING CONTAINER HAVING SEPARATE DISPENSING ORIFICE AND AIR INTAKE PASSAGE

(75) Inventor: Vincent De Laforcade, Rambouillet (FR)

(73) Assignee: L'Oreal S.A., Paris (FR)

( * ) Notice: Subject to any disclaimer, the term of this patent is extended or adjusted under 35 U.S.C. 154(b) by 90 days.

(21) Appl. No.: 09/817,262

(22) Filed: Mar. 27, 2001

(65) Prior Publication Data

US 2002/0005415 A1 Jan. 17, 2002

(30) Foreign Application Priority Data

Mar. 27, 2000 (FR) ..... 00 03847

(51) Int. Cl.[7] ..... B67D 3/00
(52) U.S. Cl. ..... 222/483; 222/496
(58) Field of Search ..... 222/483, 481.5, 222/482, 496

(56) References Cited

U.S. PATENT DOCUMENTS 3,705,668 A 12/1972 Schwartzman
3,874,563 A 4/1975 Schwartzman
4,747,522 A 5/1988 McIntyre
4,785,978 A * 11/1988 Kano et al. ..... 222/482
5,718,383 A 2/1998 Smith et al.
6,378,742 B1 * 4/2002 Rohr et al. ..... 222/494

FOREIGN PATENT DOCUMENTS

| | | |
|---|---|---|
| DE | 41 19 634 | 12/1992 |
| EP | 0 500 249 | 8/1992 |
| GB | 1 058 323 | 2/1967 |
| GB | 2 169 384 | 7/1986 |

OTHER PUBLICATIONS

English language Derwent Abstract of DE 41 19 634, Dec. 17, 1992.

* cited by examiner

*Primary Examiner*—Philippe Derakshani
(74) *Attorney, Agent, or Firm*—Finnegan, Henderson, Farabow, Garrett & Dunner LLP

(57) ABSTRACT

A dispensing cap for a product container, preferably a cosmetic product container, is provided. The cap includes a movable member comprising a valving portion capable of selectively opening and closing a product-dispensing orifice depending upon pressure within the container. The cap also includes an elastically deformable mounting element coupled to the movable member to retain the movable member on the cap, and the mounting element comprises a sealing member configured to selectively open and close at least one air intake passage, the air intake passage being separate from the product-dispensing orifice.

47 Claims, 7 Drawing Sheets

CAP FOR DISPENSING CONTAINER HAVING SEPARATE DISPENSING ORIFICE AND AIR INTAKE PASSAGE

The present invention relates to a cap intended to fit a container of the type used for packaging and dispensing products, preferably cosmetic products such as hair-care products, body-care products, skin-care or makeup products, or sun-protection products. The present invention also relates to containers fitted with such a cap.

In the field of cosmetics, particularly in the field of hair-care products (shampoos and conditioners) or body-care products (shower gel or liquid soap), a good many products are intended to be used in the shower. One of the problems encountered with the containers commonly used for packaging such products stems from the fact that these containers generally have an end wall and are surrounded by a neck fitted with a screw-on closure or with a dispensing cap snap-fastened or screw-fitted onto the neck. On use, the closure has to be unscrewed or the cap has to be opened, the bottle has to be inverted (waiting or shaking the bottle if the bottle is almost empty), the walls of the bottle have to be squeezed to force the desired amount of product out, and the bottle has to be set down stably, and preferably restoppered using one hand, to prevent spillage in case it gets knocked over.

Recently, packaging assemblies equipped with a cap that has a flat surface so that the bottle can rest on a surface in a head-down orientation have appeared on the market. The cap is opened by squeezing the walls of the container, the cap being closed more or less automatically under the effect of the pressure created within the container and/or of the elasticity of the material of which the opening valve, also known as a "teat", is formed.

Hence, there already exist caps, marketed in particular by the company Seaquist® or Coster®, having an elastomeric membrane through which at least one slit passes. At rest, the membrane has a concave profile, the edges defining the slit being contiguous enough to provide the required level of sealing. When there is a pressure increase within the container, particularly after each use, the slit opens toward the container so as to allow air to be taken into the container. Under the pressure of the product, the membrane is capable of inverting and of exhibiting a convex profile suited to the dispensing of product through the slit.

One drawback with this type of cap stems from the hollowed profile of the membrane between two uses, which hollowed profile is liable to retain product which will dry out and which, apart from looking unattractive, may disrupt the correct dispensing of product in a subsequent use. Furthermore, behavioral studies have shown that the user, out of curiosity, tends to wish to use the device in the head-up configuration so as to watch the product coming out through the membrane. The inverting of the membrane, which takes place at relatively high speed and in sharp steps, may cause a drop of product to be expelled. The drop thus expelled may land in the user's eye.

Furthermore, air intake is problematic with this type of cap insofar as air is taken in through the same passage through which the product leaves. The compromise required in order, on the one hand, to ensure correct sealing of the container between two uses when the container is inverted to the head-down configuration and, on the other, to allow for easy dispensing of the product is often difficult to achieve.

Hence, one of the optional subjects of the invention is to produce a cap intended to fit a container, preferably a container designed particularly for packaging cosmetic products, and wherein the cap may solve one or more of the problems mentioned hereinabove with reference to the conventional devices.

In particular, one optional subject of the invention is to produce a cap simply and economically, which offers good flexibility in use, and which makes it possible to maintain satisfactory cleanliness and hygiene in the course of use.

Another optional subject of the invention is to produce such a cap which offers a good compromise between effective air intake without appreciably detracting from the sealing of the container on which it is mounted and easy dispensing of the product.

Yet another optional subject of the invention is to provide a container having a dispensing cap according to the invention, wherein the assembly offers good peace of mind when being transported, is stable when stored head down, and allows the product to be immediately available for use.

Other subjects may become apparent in the detailed description which follows. It should be understood that certain aspects of the invention could be practiced without accomplishing one or more of these subjects.

According to one aspect of the invention, a dispensing cap is provided for a product container, preferably a container designed particularly for packaging a cosmetic product. The cap comprises a movable member having a valving portion capable, depending on the pressure within the container, of selectively opening and closing a product-dispensing orifice, the movable member being held on the cap by an elastically deformable mounting element, the mounting element also forming a sealing member within the cap, the sealing member being capable of allowing selective opening and closing of at least one air intake passage that is separate from the product-dispensing orifice.

Air may be taken in through one or more passages separate from the passage through which the product leaves. Optionally, when determining the operating parameters of such a cap, the ease with which the product can be dispensed does not have to be sacrificed for the sealing required between two uses, and vice versa. Between two uses, the air intake passage or passages may be shut off in sealed fashion, which may make it possible to maintain correctly sealed packaging. Furthermore, the same mounting element may hold the movable member in the dispensing orifice and define the sealing member capable of selectively opening and closing the air intake passage(s).

In one embodiment, the valving portion of the movable member is capable, under the action of an elastic return force exerted by the mounting element, and in the absence of raised pressure within the container, of pressing elastically on a seat at least partially defining the dispensing orifice. The valving portion may be capable, in response to a raised pressure within the container, of moving away from the seat to allow product to be dispensed through the orifice, and may be capable of returning to press in sealed fashion on the seat when the raised pressure ceases.

The valving portion of the movable member may be returned to the closed position under the combined action of the return force generated by the elastically deformable mounting element and of the pressure generated within the container in response to the dispensing of a dose of product.

In one possible embodiment, the mounting element is arranged along an axis X within an opening in a wall of the cap, a portion of the mounting element retaining the mounting element within the opening.

In one example, the seat at least partially defining the dispensing orifice is formed by the mounting element itself. Thus, when the mounting element is obtained by molding an elastomeric material, the seat on which the valving portion of the movable member presses may be elastically deformable, which may contribute to improving the seal when the dispensing orifice is closed.

The air intake passage(s) may be formed between an edge defining the opening in the wall and the mounting element. The air intake passage(s) may be formed of a continuous annular passage formed right around the mounting element or of a number of discontinuous passages spaced uniformly around the mounting element.

For example, the mounting element is at least partially made of an elastomeric material chosen from thermoplastic elastomers or crosslinked elastomers. By way of example, mention may be made of nitriles, butyls, silicones, natural or synthetic latices, EPDMs, polyurethanes, blends of polypropylene and SBS, SEBS or EPDM, very-low-density polyethylene, blends based on polyester glycols (TPUs) or on polyether glycols (PEBA and COPE) and flexible polyvinyl chlorides (PVCs). Depending on the embodiment adopted, such a material may have a hardness of between 20 Shore A and 40 Shore D, and preferably between 40 Shore A and 75 Shore A. Its elasticity may range from 0.5 to 5 MPa and preferably from 0.8 to 2 MPa (tensile stress at 100% elongation).

According to a one possible embodiment, when the pressure within the container is below a predetermined value, the sealing member is in sealed contact with a seat formed within the container, around at least a part of the opening in the wall, the sealing member being capable of moving away from the interior seat when the predetermined value is reached, so as to allow air to be taken into the container and, by elastic return, of returning to its position in sealed contact with the interior seat when the pressure within the container drops back below the predetermined value.

The mounting element may be retained by an annular portion of the mounting element having a maximum diameter greater than the smallest diameter of the opening in the wall, the annular portion having an interior edge defining the dispensing orifice.

According to an optional embodiment, the mounting element comprises an intermediate portion formed between the annular portion and the sealing member, the intermediate portion being in communication with the dispensing orifice and passing through the opening in the wall so as to extend over at least part of its axial height within the container. For example, the intermediate portion is of annular shape and is centered on the dispensing orifice.

According to one possible aspect of the invention, the sealing member is formed by a skirt formed by the mounting element and turned back toward the interior seat on the intermediate portion, the turned-back skirt, when the pressure within the container is below the predetermined value, being forced elastically so that a zone of the skirt is in sealed contact with the interior seat.

The zone intended to provide sealing may be a zone of the skirt located away from the free edge of the skirt, the seat being equipped with a rim against which the sealing zone of the skirt comes into sealed contact. For example, the sealing zone is located a distance of between 0.5 and 3 mm away from the free edge of the skirt. In this example, even more variation about the turning-back zone is allowed, which variation will influence which zone of the skirt will be in contact with the rim without however preventing it from playing its part satisfactorily. The seat may include a rim formed by the wall of the cap near the passage passing through the wall and onto which the sealing zone of the skirt is pressed.

According to another embodiment, the sealing zone includes a lip formed by the free edge of the skirt.

The skirt may be turned back about a folding zone defined by an annular groove, the profile of which may be substantially V-shaped or substantially U-shaped and which is formed between the intermediate portion and the skirt on an interior surface of the mounting element. Other groove profiles are also possible.

In one example, the movable member is held between a first stop, formed by the seat of the dispensing orifice, and with which the valving portion of the movable member engages in the absence of raised pressure within the container, and a second stop formed by the mounting element and with which a catch portion of the movable member is in elastic engagement.

According to one optional embodiment, the second stop includes the free edge of an axial skirt formed by the mounting element, the free edge of the skirt, in the absence of raised pressure within the container, being forced into elastic engagement with the catch portion of the movable member so as to force the valving portion of the movable member to press in sealed fashion on the seat at least partially defining the dispensing orifice. When it is thus forced into elastic engagement, the skirt is axially compressed. The compression becomes more pronounced under the pressure of the product which means that the valving portion of the movable member can detach from the seat of the dispensing orifice.

According to this embodiment, the catch portion of the movable member may be formed of a ring arranged at the opposite end of the movable member to the valving portion and secured to the movable member via a number of uniformly spaced radial tabs, an interior edge of the ring defining, in collaboration with the tabs, a number of passages for the product to pass through when moving toward the dispensing orifice.

According to another optional embodiment of the invention, the second stop includes an annular portion of the mounting element gripping/encircling a portion of the movable member. The catch portion of the movable member is intended to engage elastically with the annular portion of the mounting element so as to force the valving portion of the movable member to press in sealed fashion on the seat at least partially defining the dispensing orifice. Thus, when the movable member is mounted on the mounting element, the annular portion of the mounting element is forced elastically toward the dispensing orifice so that the valving portion of the movable member, under the effect of the return force exerted by the annular portion of the mounting element, presses elastically on the seat of the dispensing orifice.

The catch portion may be formed of a larger-diameter portion of the movable member, formed at the opposite end to the valving portion. The catch portion of the movable member is given the ability to pass over the annular portion of the mounting element by the elastic deformability of the material of which the annular portion is made. Alternatively, the catch portion of the movable member may be formed by hot-deformation after the movable member has been mounted on the mounting element.

According to this other embodiment, the annular portion of the mounting element may be arranged within the intermediate portion and connected to the intermediate portion by a number of uniformly spaced radial tabs so as to define a number of passages for the product toward the dispensing orifice.

The valving portion of the movable member may have an exterior surface designed so that, when the valving portion of the movable member is pressed in sealed fashion on the seat at least partially defining the dispensing orifice, the exterior surface is aligned with or set back from an exterior surface of the wall of the cap. Thus, the container can rest in a stable manner on the exterior surface of the cap, which in particular allows the container to be set down head down, and for this to be done in a very stable manner. As a result of this, on each repeat use, the product is immediately available.

For example, the opening within which the mounting element is arranged is formed of a first portion outside the container and extending over part of the thickness of the wall, the first portion having a first diameter; and of a second portion within the container and extending over the remainder of the thickness of the wall, the second portion having a second diameter smaller than the first diameter, the sealing member having a minimum diameter greater than the second diameter.

Within the meaning of the present invention, the term "diameter" is to be understood as meaning the diameter of the circle in which the cross section of the passage, or of any other element being referred to where mention is made of a diameter, can be inscribed. Although a circular cross-section is preferred, it is, however, possible to envision cross-sections of different shapes.

The first portion of the passage may be separated from the second by a shoulder intended to be brought into engagement with a corresponding shoulder formed by the mounting element, one or more grooves being formed at least on the surface of one or other of the shoulders so as to form at least one air intake passage. The grooves may be continued axially on the lateral edge of the first and second portions.

The cap according to the invention may comprise a lid, particularly one hinged to the cap, capable of removably covering the dispensing orifice. The lid may include structure permitting the lid to be retracted, and locked in the retracted position (particularly by snap-fastening), so that the container can rest directly on the surface of the cap in which the dispensing orifice is made. Thus, on each repeat use, the dispensing of the product is even more immediate. The lid may be hinged to the cap by at least one film hinge or by any other articulation mechanism, particularly of the assisted opening and assisted closure type.

The cap according to the invention may comprise a connector to fix, particularly by snap-fastening or screw-fastening, the cap on a container. A cap such as this may be obtained by molding a thermoplastic material such as a polyethylene, a polypropylene or a polyvinyl chloride. The movable member and its associated mounting element may be mounted after the cap has been molded.

The movable member may also be obtained by molding a thermoplastic material, for example one which is not elastically deformable, such as a polyethylene or a polypropylene.

According to another aspect of the invention, there is a dispenser comprising a container designed particularly for packaging a cosmetic product, and fitted with a cap according to the present invention.

Such a container may comprise a container body, one end of which is closed by an end wall, another end of the container forming a neck, a free edge of which defines an opening, the cap being mounted on the neck of the container. The body of the container preferably comprises at least one elastically deformable wall so that pressure applied to the deformable wall(s) causes a raised pressure within the container capable of forcing the valving portion of the movable member of the cap to move away from the seat of the dispensing orifice and allow the product to leave through the dispensing orifice.

The invention also relates to the use of such a container for dispensing a cosmetic product.

According to one aspect of the invention, a dispensing cap is provided. The dispensing cap comprises a movable member comprising a valving portion configured to selectively open and close a product-dispensing orifice depending on pressure in a container, and an elastically deformable mounting element coupled to the movable member to retain the movable member on the cap, the mounting element comprising a sealing member configured to selectively open and close at least one air intake passage, the at least one air intake passage being separate from the product dispensing orifice.

According to another aspect of the invention, a dispenser for a product is provided. The dispenser comprises a container body, and a dispensing cap comprising a movable member comprising a valving portion configured to selectively open and close a product-dispensing orifice depending on pressure in a container, and an elastically deformable mounting element coupled to the movable member to retain the movable member on the cap, the mounting element comprising a sealing member configured to selectively open and close at least one air intake passage, the at least one air intake passage being separate from the product dispensing orifice on the container body.

This dispenser may include a product in the container body, the product being chosen from a hair-care product, a shampoo, a body-care product, a skin-care product, a makeup product, and a sun-protection product.

According to yet another aspect of the invention, a method of dispensing a product is provided. The method comprises providing a dispenser comprising a container body, and a dispensing cap comprising a movable member comprising a valving portion configured to selectively open and close a product-dispensing orifice depending on pressure in a container, and an elastically deformable mounting element coupled to the movable member to retain the movable member on the cap, the mounting element comprising a sealing member configured to selectively open and close at least one air intake passage, the at least one air intake passage being separate from the product dispensing orifice on the container body, wherein the container body contains a product, increasing pressure inside the container body to cause the valving portion of the movable member to open the dispensing orifice, and dispensing the product through the dispensing orifice.

The increasing pressure may include deforming at least one wall of the container body.

The method may further include decreasing pressure inside the container body, and moving the sealing member to open the at least one air intake passage to permit flow of air into the container.

In this method, the sealing member may move in response to the decreasing pressure.

Also according to this aspect, the product may comprise a cosmetic product and the method may further comprise applying the product to at least one of hair and skin. The product may be chosen from a hair-care product, a body-care product, a skin-care product, a makeup product and a sun-protection product, and the method may further comprise applying the product to at least one of hair and skin.

Apart from the provisions set out hereinabove, the invention includes a certain number of other provisions which will be dealt with hereinafter, with regard to non-limiting exemplary embodiments which are described with reference to the appended drawings, among which:

Figure 1A:
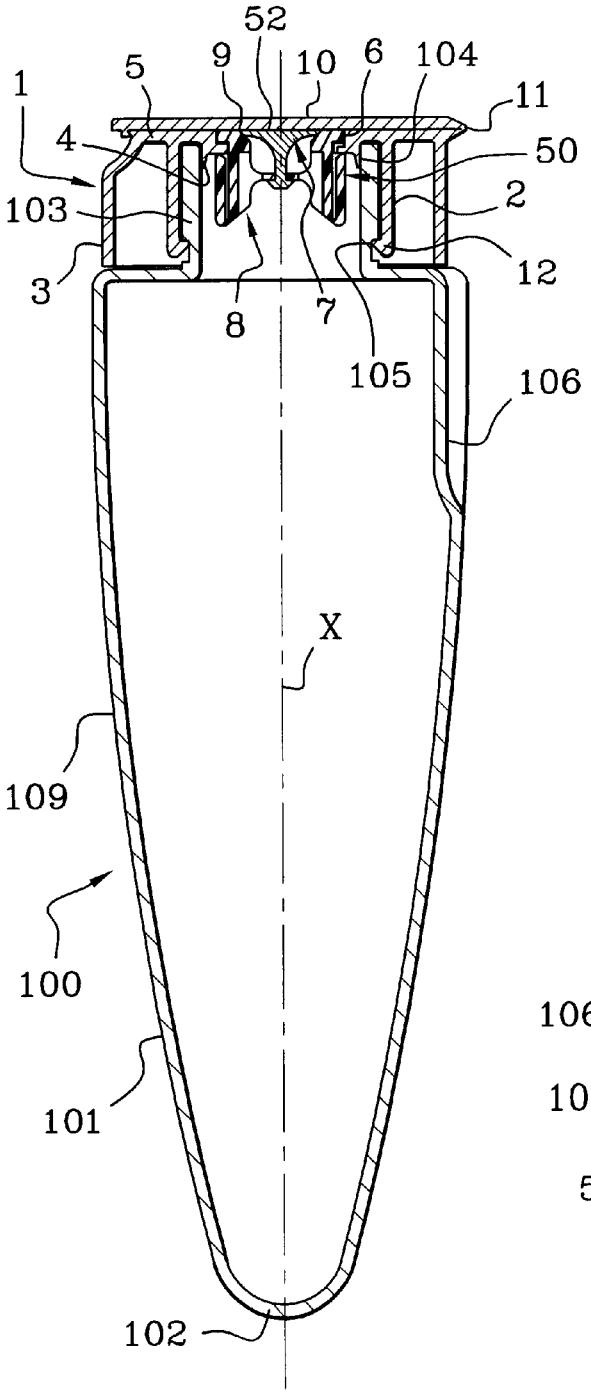
FIGS. 1A–1B are cross-sectional side views of a container fitted with a cap according to a first embodiment of the invention.
Figure 1B:
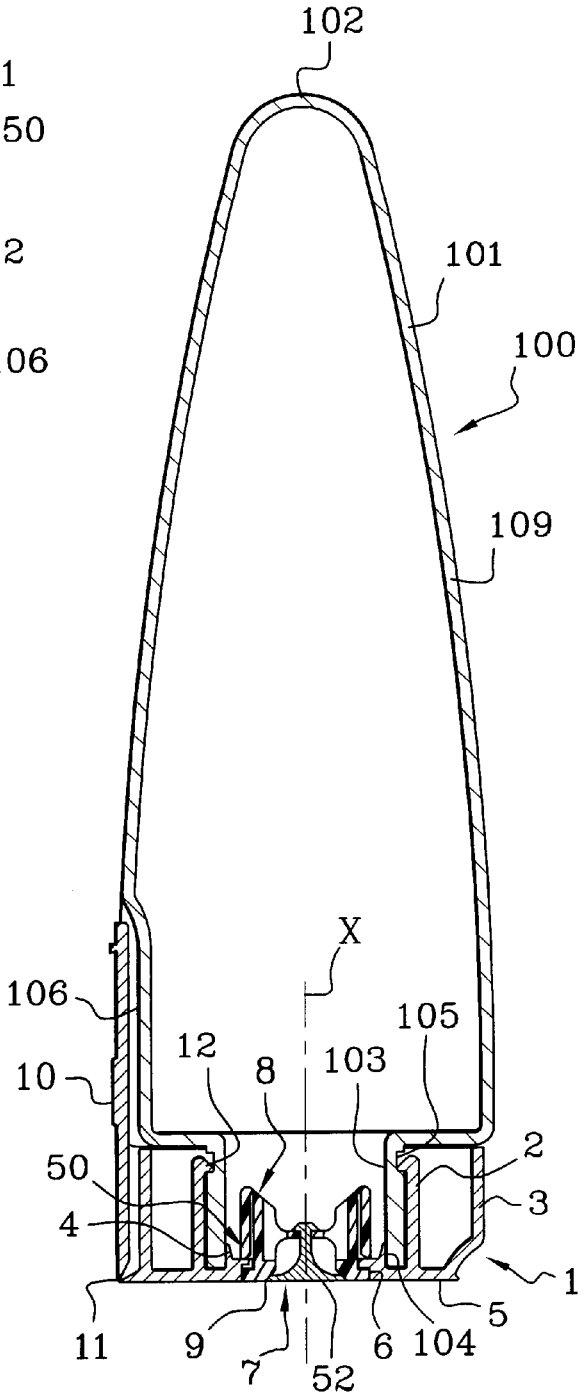

The container 100 depicted in FIGS. 1A and 1B comprises a body 101, one end of which is closed by a rounded end wall 102. The body 101 of the container includes flexible walls 109, preferably comprising polyethylene or polypropylene, capable of deforming under a pressure exerted by the hands of the user, and of returning to their initial shape when the pressure ceases. The body 101 at its opposite end to the end wall 102 forms a neck 103, a free edge of which defines an opening 104. The neck 103 on its exterior surface has a groove 105 capable of accommodating a bulge 12 formed on the internal surface of a catching skirt 2 formed by a cap 1.

The cap 1 comprises a decorative skirt 3 formed in the alignment of the body 101 of the container 100, and a sealing skirt 4 which can be inserted in sealed fashion inside the opening 104 of the container 100. The skirts 2, 3 and 4 are carried by a transverse wall 5 of cap 1. Passing through the transverse wall 5 is a opening 6 formed along its axis X, and in which is mounted a moving valving member 7 coupled to a mounting element 8 made of elastomeric material and in particular defining a dispensing orifice 9 for dispensing the product. The opening 6, the movable member 7, and the mounting element 8 will be described in detail with reference to the figures which follow.

In FIG. 1A, which depicts the container 100 in a transport position, a lid 10, hinged to the cap 1 by means of a film hinge 11, has been folded down onto the transverse wall 5 of the cap. In this position of FIG. 1A, the lid 10 is removably locked to the cap 1 by means of an appropriate snap-fastening system.

As depicted in FIG. 1B, which illustrates a position "on standby" between two uses, the lid 10 is retracted and is immobilized in an appropriate depression 106 formed by the upper lateral part of the body 101 of the container 100. The container 100 rests on a flat surface, head down, the transverse wall 5 of the cap 1 resting directly on the flat surface. The valving portion of the movable member 7 has an exterior surface 52 which, when the container 100 is in the closed position, is aligned with the exterior surface of the transverse wall 5, thus allowing the container to be able to rest in a stable manner on the surface 5 of the cap 1.

Figure 2:
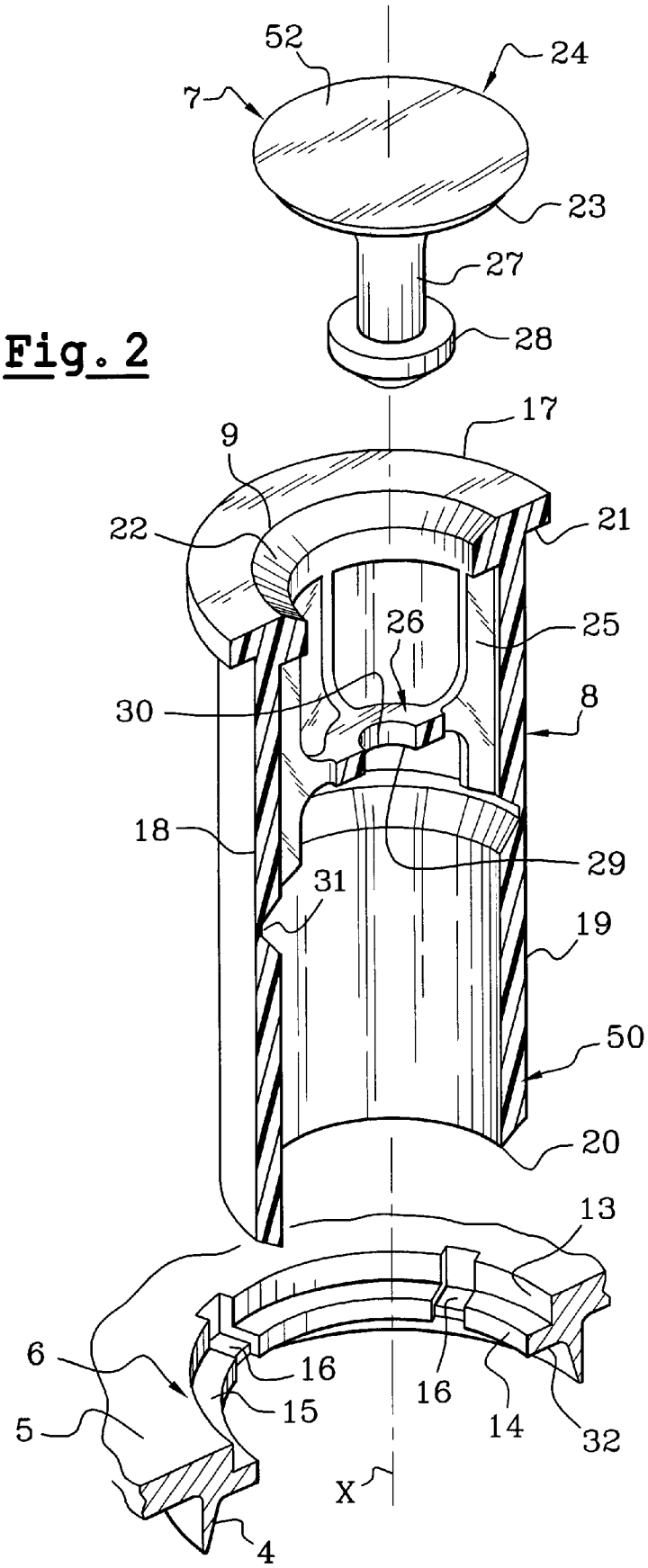
FIG. 2 is a partial exploded perspective view of a movable member and mounting element of a cap according to the first embodiment.

Reference is now made to FIG. 2 which depicts, in perspective, an exploded view of the opening 6 in the wall 5 of the cap 1, of the mounting element 8 and of the movable member 7 with valving portion 24.

The opening 6 is formed within the sealing skirt 4 of the cap. It comprises, over about half the thickness of the wall 5, a first (exterior) portion 13 which is continued, over the remainder of the thickness of the wall, by a second (interior) portion 14, of smaller diameter than the first portion 13. The two portions 13, 14 are separated by a shoulder portion 15 on the surface of which a number of radial grooves 16 are formed. The radial grooves 16 of the shoulder portion 15 are continued vertically onto the lateral edge of the portions 13 and 14 of the opening 6.

The mounting element 8 is intended to be inserted in the opening 6 of the wall 5 of the cap 1 and preferably comprises molded silicone rubber. Mounting element 8 comprises an annular base 17 having a larger-diameter portion. The base 17 is intended to allow the element 8 to be retained within the opening 6. The maximum diameter of the base 17 is approximately equal to the inside diameter of the portion 13 of the opening 6 (at the tops of the grooves 16). The base 17 is extended by a cylindrical skirt 18, or "foot", forming an intermediate part between the base 17 and a skirt 19 at the end of which is formed a sealing lip 20 that will be dealt with in greater detail later. The foot 18 has a diameter approximately equal to the inside diameter of the portion 14 of the opening 6 (at the tops of the grooves 16). A shoulder 21 is formed between the base 17 and the foot 18 and can engage with the shoulder portion 15 of the opening 6 passing through the wall 5 of the cap 1 thus defining, facing the grooves 16, a number of air intake passages extending over the entire thickness of the wall 5. The axial height of the foot 18 is such that, when the shoulder 21 is pressing against the shoulder portion 15, the foot 18 emerges significantly inside the container.

The base 17 forms an annular element, an interior edge of which defines an orifice 9 for dispensing the product, which is formed at the top of a chamfered part 22 forming a seat capable of housing a corresponding chamfered portion 23 formed by the peripheral edge of a valving portion 24 of the movable member 7 which will be discussed in greater detail later.

Extending radially within the intermediate portion 18 of the mounting element 8 are a number of uniformly spaced tabs 25, of which one end, opposite to the end attached to the intermediate portion 18, is connected to an axial ring 26, an interior edge 29 of which defines an axial passage 30. The axial passage 30 has a diameter slightly greater than the maximum diameter of a cylindrical connecting element 27 formed between the valving portion 24 of the movable member 7 and a catch portion 28 of the movable member 7. The catch portion 28 has a maximum diameter greater than the diameter of the axial passage 30.

Figure 3A:
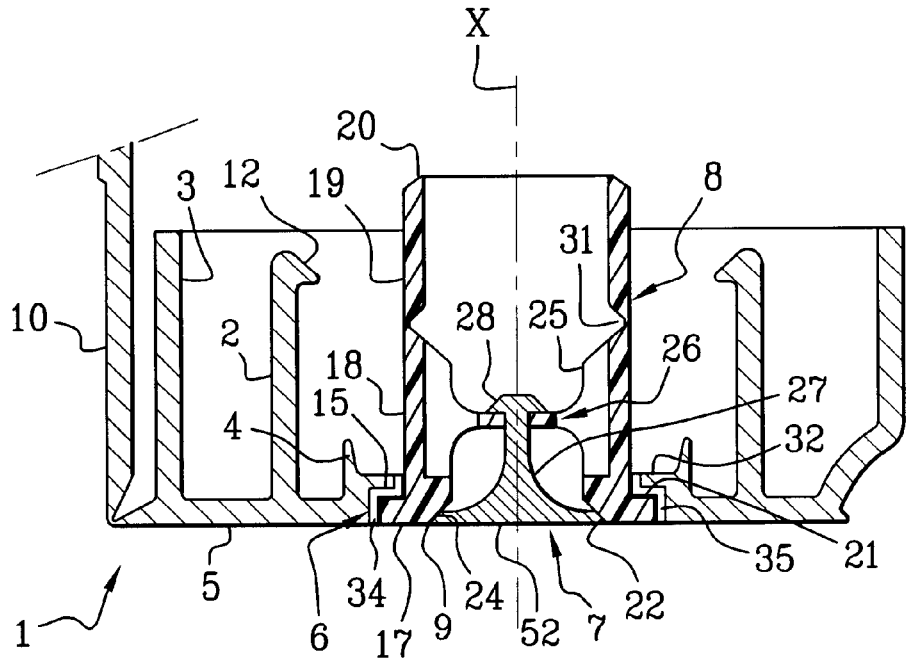
FIGS. 3A–3B are cross-sectional side views illustrating the mounting of a cap according to the first embodiment.

The movable member 7 and the mounting element 8 are assembled by causing the catch portion 28 of the movable member to pass through the axial passage 30, this being allowed thanks to the elastic deformability of the mounting element 8. In this assembled configuration as depicted in FIG. 3A, the moving element 7 is kept in abutment between the seat 22 of the mounting element 8 and the ring 26 of the mounting element 8 with which the catch portion 28 of the movable member 7 elastically engages. The chamfered edge 23 of the valving portion 24 of the movable member 7 presses elastically on the seat 22 formed by the mounting element 8. The elastic pressure results from the elastic forcing toward the dispensing orifice 9 to which the annular element 26 is subjected. For this purpose, the axial length of the cylindrical connecting element 27 of the movable member 7 is chosen appropriately with respect to the distance between the seat 22 of the mounting element 8 and the annular element 26.

A sealing lip 20 is formed by the beveled edge of the skirt 19, formed in the continuation of the intermediate portion 18. The walls of the skirt 19 are of small thickness (of the order of 1 mm thick or less). At the junction between the skirts 18 and 19 is formed a substantially V-shaped (or substantially U-shaped) groove 31 which, as will be seen in greater detail later, is intended to encourage the skirt 19 to turn back onto the intermediate portion 18.

Figure 3B:
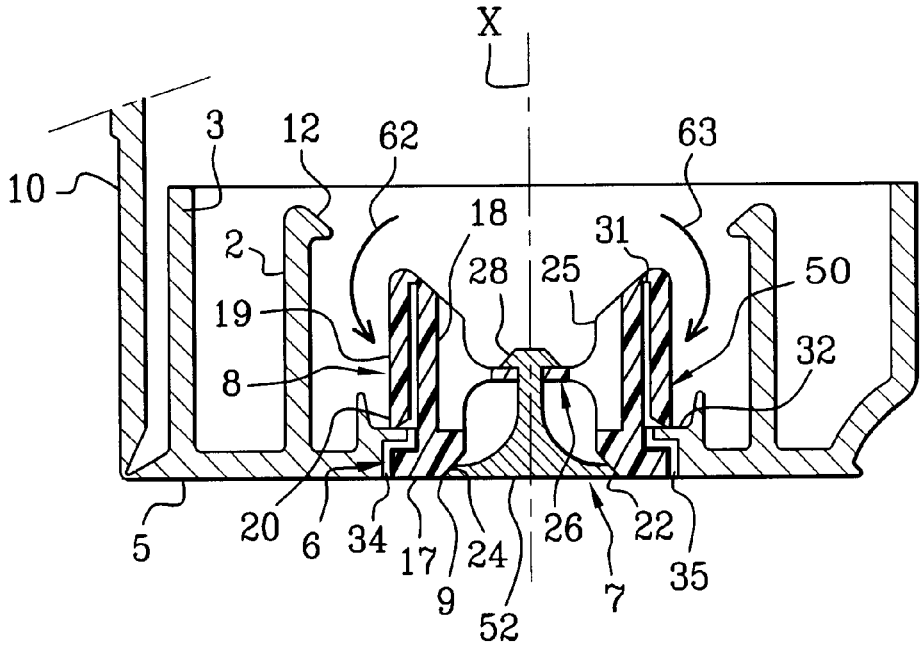

The insertion of the mounting element 8 (on which the movable member 7 will already have been mounted in the way mentioned earlier) in the opening 6 in the wall 5 of the cap 1 is illustrated in FIGS. 3A and 3B.

In FIG. 3A, the mounting element 8 is introduced into the opening 6, the skirt 19 being the continuation of the intermediate part 18. The mounting element 8 is pushed into the opening 6 until the shoulder 21 engages the shoulder portion 15. As a result of this, a number of air intake passages 34, 35 passing through the thickness of the wall 5 of the cap are defined by the grooves 16 in combination with the edge portions of the mounting element 8 which are located facing these grooves 16. Having been pushed fully in, the skirt 19 is turned back toward the outside of the mounting element 8 (see arrows 62, 63 in FIG. 3B) so that it is pressing elastically again on the intermediate portion 18, the turning-back being at the V shaped groove 31. The length of the skirt 19 is chosen so that, in the turned-back position illustrated in FIG. 3B, the lip 20 is elastically compressed somewhat between the turning-back zone 31 and the interior surface 32 of the cap defining the opening 6. This interior surface 32 thus forms a seat against which the sealing lip 20 elastically presses.

When the cap 1 is in the configuration of FIG. 3B, the valving portion 24 of the movable member 7 is pressing in sealed fashion on the seat 22 defining the product-dispensing orifice 9. Likewise, the sealing lip 20 is pressing in sealed fashion on the interior seat 32 formed by the edge of the wall 5 defining the opening 6. Thus, the air intake passages 34, 35 are isolated from the interior of the container 100 by lip 20. Such a configuration corresponds to the configuration that the container is in between two uses.

Figure 4A:
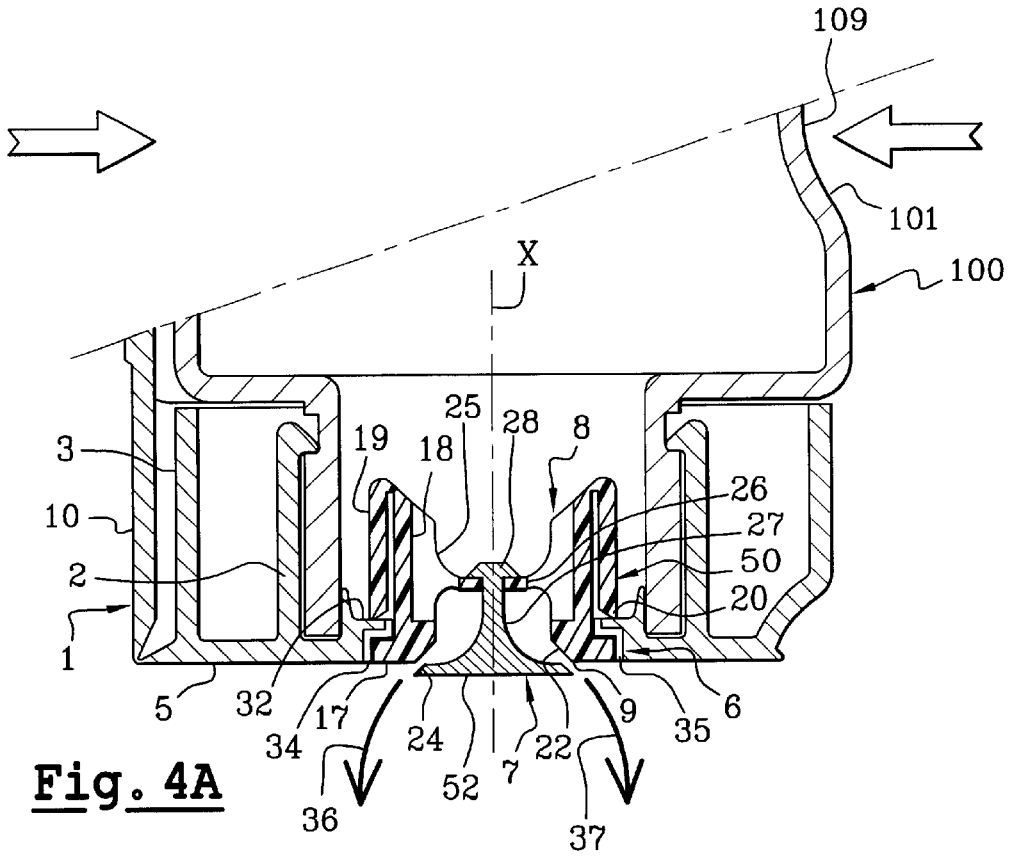
FIGS. 4A–4B are cross-sectional side views illustrating the operation of a cap according to the first embodiment.
Figure 4B:
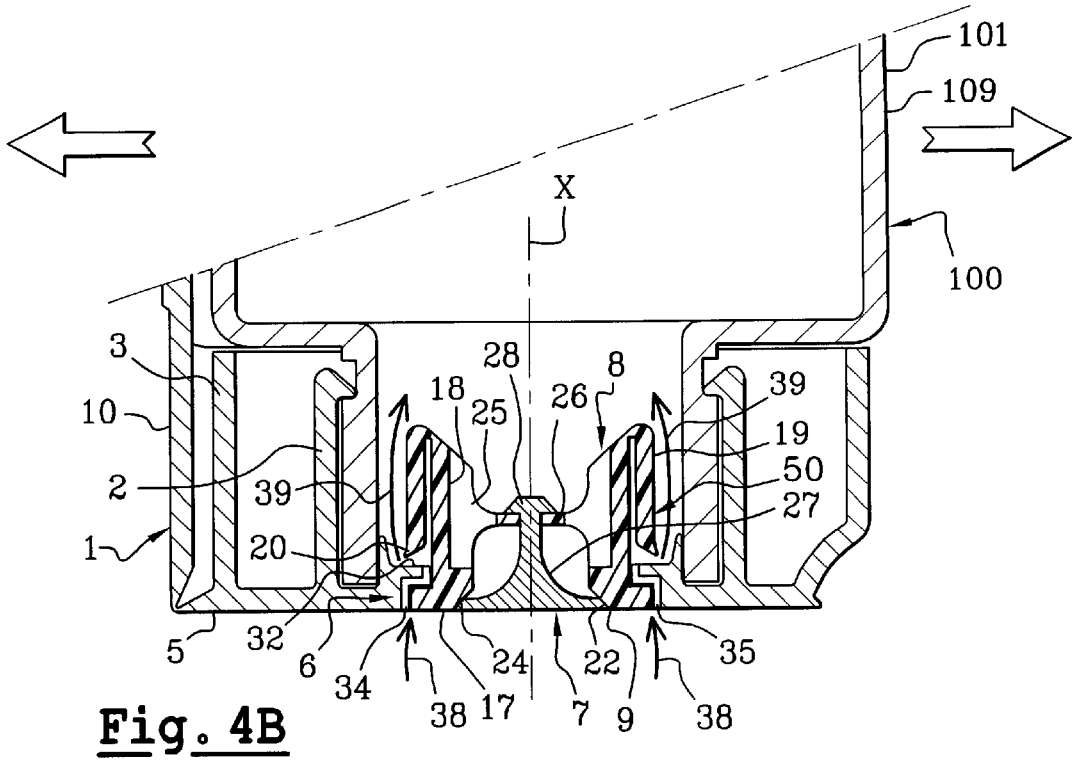

FIGS. 4A and 4B depict a partial view of a container 100 on which a cap 1 according to the one discussed with reference to FIGS. 2 and 3A–3B is mounted. According to what has been illustrated in FIG. 4A, by exerting pressure on the walls 109 of the container 100, the product that it contains is pressurized, which forces the valving portion 24 of the movable member 7 to detach from the seat 22 defining the dispensing orifice 9. The product leaves via the annular passage formed right around the valving portion 24 of the member 7. The leaving of the product is illustrated by the arrows 36, 37. In such a configuration of raised pressure within the container 100, the sealing lip 20 presses in sealed fashion against the seat 32 surrounding the opening 6 passing through the wall 5 of the cap, thus preventing the product from entering the air intake passages 34 and 35.

In FIG. 4B, when the user releases the pressure exerted on the walls 109 of the container 100, the walls 109 of the container 100 return by elastic return to their initial shape, which creates a vacuum within the container, which vacuum, in combination with the elastic return exerted by the ring 26 of the mounting element 8, causes the valving portion 24 of the movable member 7 to return into sealed contact with the seat 22 defining the dispensing orifice 9. The dispensing of product is thus interrupted. The pressure within the container forces the sealing lip 20 formed by the skirt 19 to detach from the seat 32 surrounding the opening 6 within the container 100. Air is thus drawn into the container 100 via the passages 34 and 35 until the nominal pressure within the container is reestablished. The arrows 38, 39 symbolize the flows of air toward the container 100. At that moment, the lip 20 returns by elastic return to press in sealed fashion on the seat 32, thus resealing the container 100. The container can then be repositioned, head down, on an appropriate surface, which allows the product to drop under gravity into contact with the dispensing cap 1. The container 100 is thus ready for repeat use, without requiring preliminary manipulation.

Figure 6A:
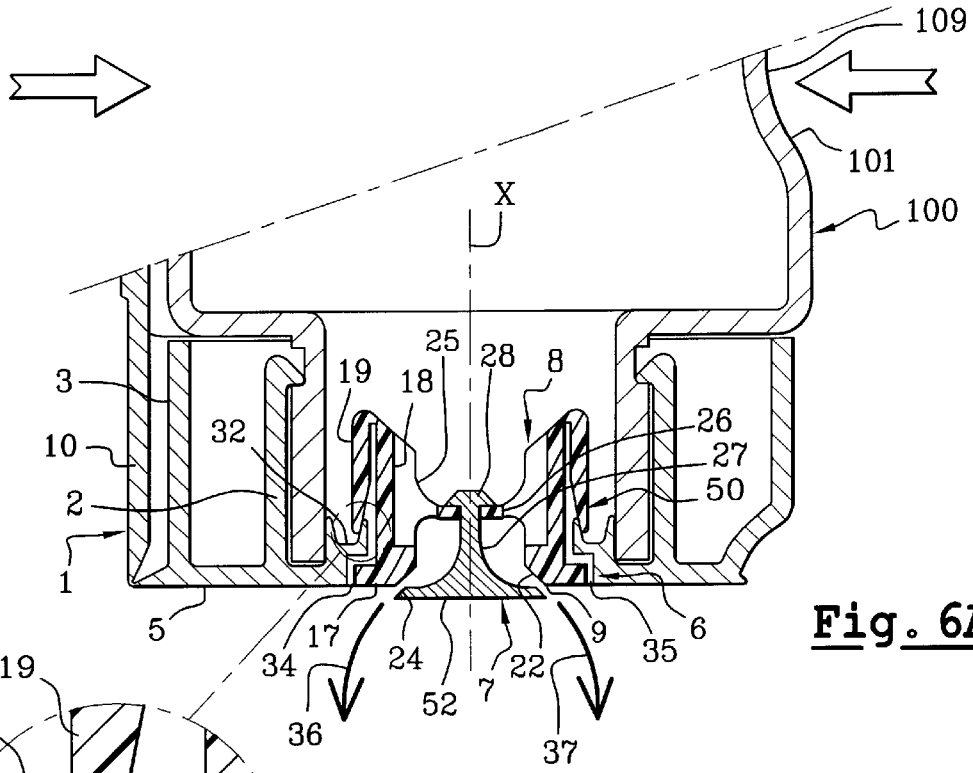
FIGS. 6A and 6C are cross-sectional side views of a variant of the first embodiment of the cap.
Figure 6B:
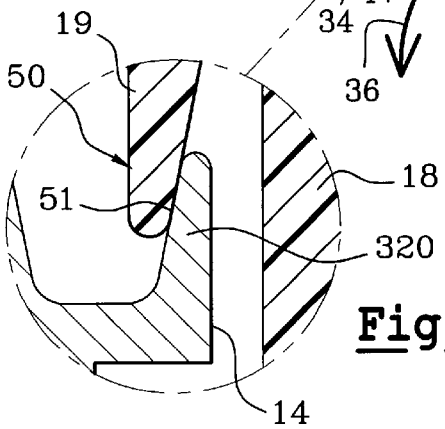
FIG. 6B is an enlarged view of the circled area in FIG. 6A.
Figure 6C:
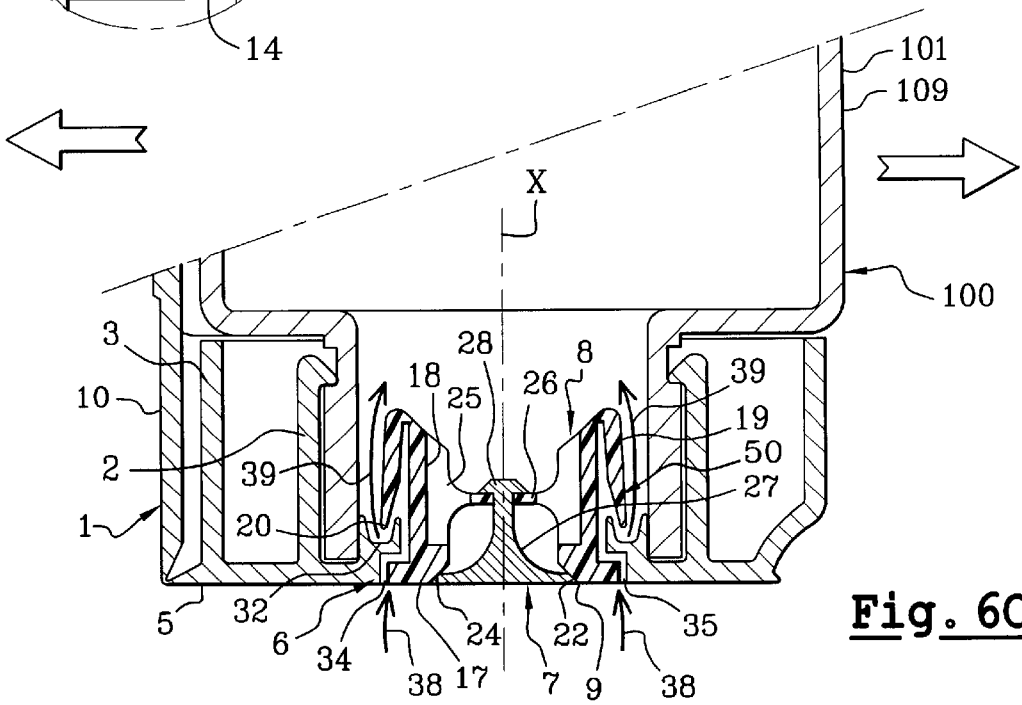

According to a preferred embodiment depicted in FIGS. 6A to 6C, the second portion 14 of the opening 6 is continued along the axis X by a rim 320 around the opening 6 in the wall 5 and toward the inside of the container. By using such an arrangement, the zone of the skirt 19 intended to be in sealed contact with the seat 32 is, in this case, a zone 51 of the skirt located away from the free edge of the skirt. The skirt 19 is turned back toward the outside of the mounting element 8 so that it presses, this time, on the rim 320. The length of the skirt 19 is chosen so that, in the turned-back position, the zone 51 of the skirt 19 comes into sealed contact with part of the rim 320.

The embodiment which will now be discussed with reference to FIGS. 5A 5C differs from the previous embodiment in the configuration of the movable member 7 and, in particular, in the way in which the valving portion 24 is forced to press elastically on the seat 22 defining the dispensing orifice 9. The other parts of the cap 1 and, in particular, all the components relating to the air intake are identical to those of the previous embodiment. In consequence, they will not be described again with reference to this embodiment.

According to this embodiment, the catch portion 28 of the movable member 7 is formed of a washer, which is connected to the cylindrical connecting element 27 of the movable member 7 by a number of uniformly spaced tabs 40, 41 so that a number of passages for the product to pass through are formed between tabs 40, 41 and the interior edge 42 of the washer 28. A skirt 43 extends axially from the annular base 17 of the mounting element 8 as far as a free end 44 in abutment against the surface of the washer 28 facing toward the base 17 of the mounting element 8. The length of the cylindrical connecting element 27 of the movable member 7 is chosen so that the skirt 43, the free end of which is engaged against the washer 28, is partially compressed when there is no raised pressure within the container. Thus, by elastic return, the skirt 43 forces the valving portion 24 to press in sealed fashion on the seat 22 defining the dispensing orifice 9.

Figure 5A:
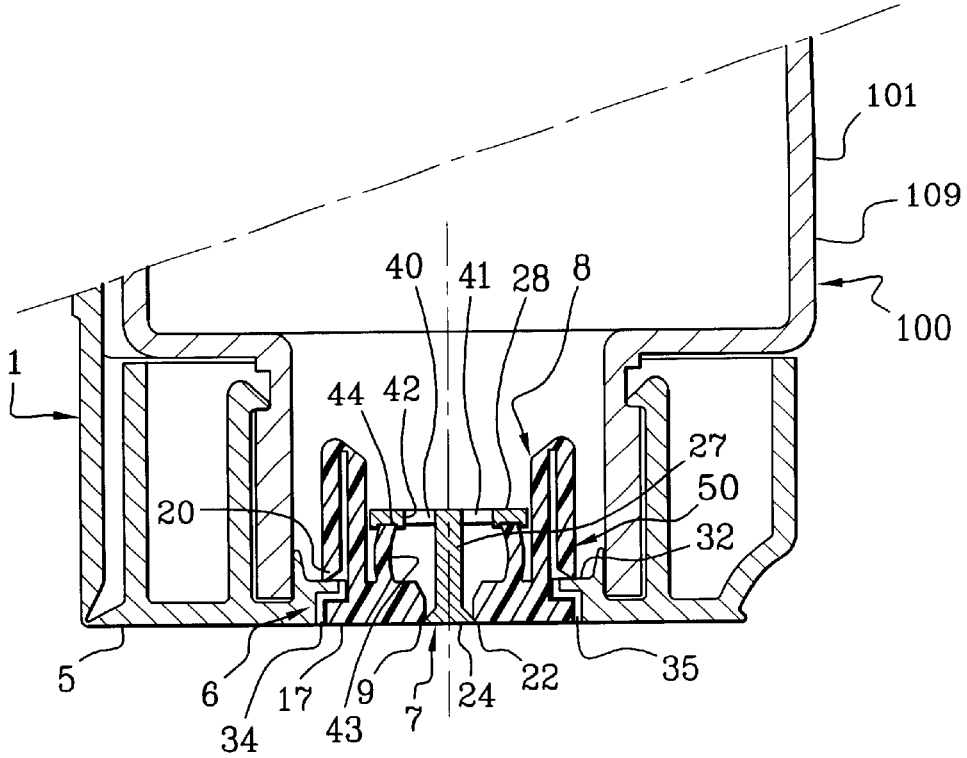
FIGS. 5A–5C are cross-sectional side views of a cap and its operation according to a second embodiment of the present invention.

In FIG. 5A, the valving portion 24 of the movable member 7 is pressed in sealed fashion on the seat 22 defining the product-dispensing orifice 9. Likewise, the sealing lip 20 is pressed in sealed fashion on the interior seat 32 formed by the edge of the wall 5 defining the opening 6. Thus, the air intake passages 34, 35 are isolated from the interior of the container 100 by lip 20. Such a configuration corresponds to the configuration that the container is in between two uses.

Figure 5B:
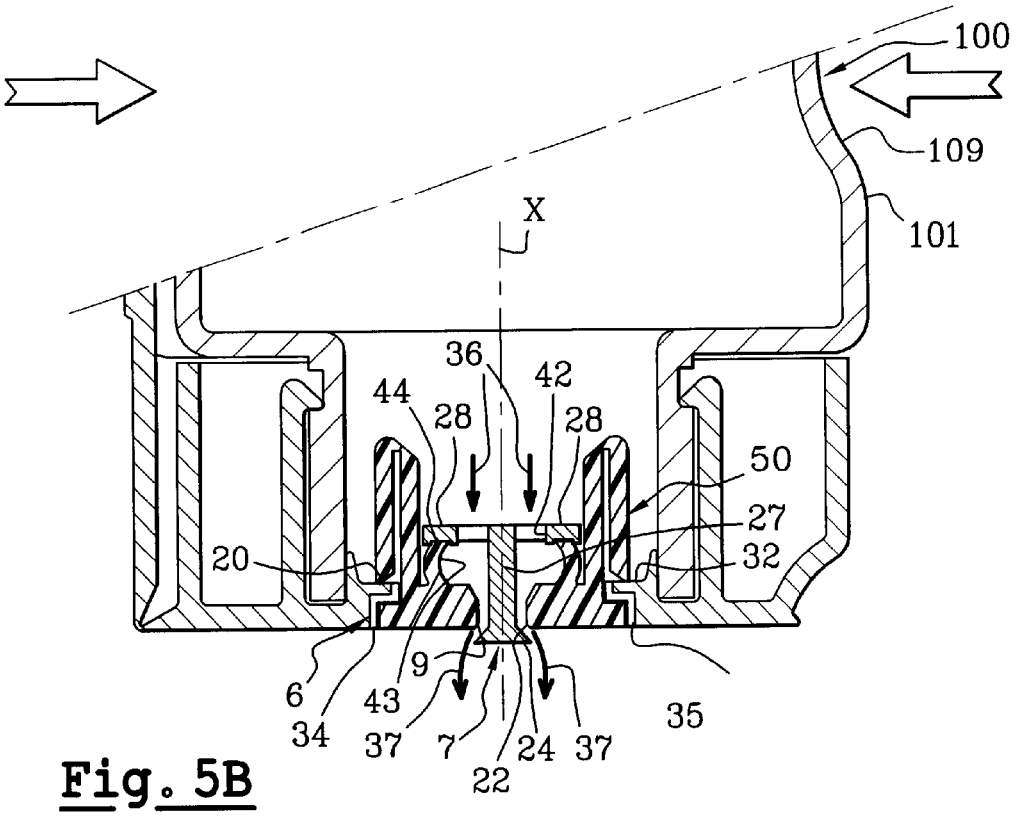

In FIG. 5B, by exerting pressure on the walls 109 of the container 100, the product that it contains is pressurized, and this compresses the axial skirt 43 even more and forces the valving portion 24 of the movable member 7 to detach from the seat 22 defining the dispensing orifice 9. The product leaves by the annular passage formed right around the valving portion 24 of the member 7. The leaving of the product is illustrated by the arrows 36, 37. In such a configuration with there being a raised pressure within the container 100, the sealing lip 20 presses in sealed fashion on the seat 32 surrounding the opening 6 passing through the wall 5 of the cap, thus preventing the product from entering the air intake passages 34 and 35.

Figure 5C:
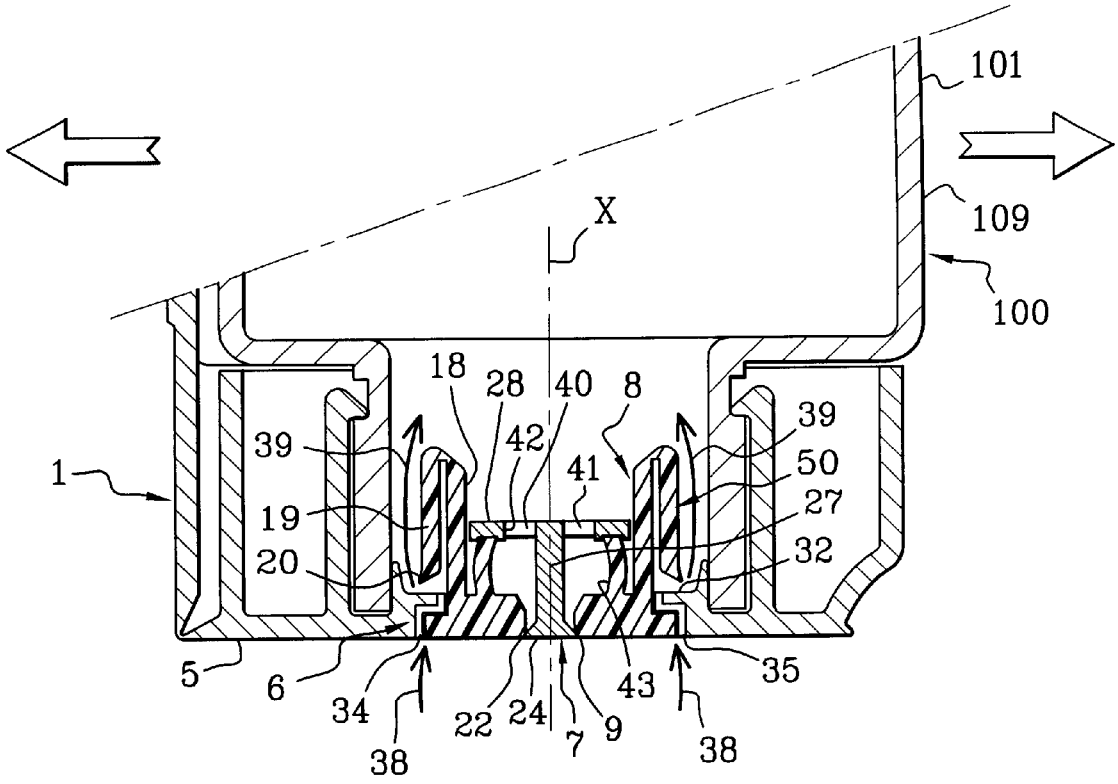

In FIG. 5C, when the user releases the pressure exerted on the body 101 of the container 100, the walls 109 of the container return by elastic return to their initial shape, which creates a partial vacuum within the container. This vacuum, in combination with the elastic return exerted by the compression of the axial skirt 43 of the mounting element 8, causes the valving portion 24 of the movable member 7 to return to press in sealed fashion on the seat 22 defining the dispensing orifice 9, thus interrupting the dispensing of product. The vacuum within the container forces the sealing lip 20 formed by the skirt 19 to detach from the seat 32 surrounding the opening 6. Air is thus drawn into the container 100 via the passages 34, 35 until the nominal pressure within the container is reestablished. The arrows 38, 39 symbolize the flows of air toward the container 100. At that moment, the lip 20 returns by elastic return to press in sealed fashion on the seat 32, thus resealing the container 100. The container 100 can therefore be repositioned, head down, on an appropriate surface, which allows the product to drop under gravity into contact with the dispensing cap 1. The container 100 is thus ready for repeat use, without requiring initial manipulation.

The variation of the opening 6 with rim 320 as illustrated in FIGS. 6A and 6B can also be incorporated into this embodiment.

The embodiment which has just been described may allow the valving portion to be produced in the form of a smaller-diameter element. The product therefore may come out more uniformly than in the previous embodiment. Furthermore, the molding geometry, particularly in the case of the mounting element 8, may be simpler than that of the previous embodiment.

In the foregoing detailed description, reference was made to embodiments of the invention. Obviously, variations can be made thereto without departing from the spirit of the invention.

What is claimed is:

1. A dispensing cap for a product container, the cap comprising:

a movable member comprising a valving portion configured to selectively open and close a product-dispensing orifice depending on pressure in a container; and an elastically deformable mounting element coupled to the movable member to retain the movable member on the cap, the mounting element comprising a sealing member configured to selectively open and close at least one air intake passage, the at least one air intake passage being separate from the product dispensing orifice.

2. A cap according to claim 1, wherein the cap is configured so that the valving portion of the movable member presses elastically on a seat at least partially defining the dispensing orifice in response to an elastic return force exerted by the mounting element in the absence of raised pressure within the container.

3. A cap according to claim 2, wherein the cap is configured so that the valving portion of the movable member moves away from the seat to allow product to be dispensed through the orifice in response to raised pressure within the container and, wherein the cap is further configured so that the valving portion presses in sealed fashion on the seat when the raised pressure ceases.

4. A cap according to claim 1, wherein the cap further comprises a wall and an opening in the wall, the cap being configured to retain the mounting element within the opening.

5. A cap according to claim 2 wherein the mounting element forms the seat.

6. A cap according to claim 4, wherein the at least one air intake passage is formed between an edge defining the opening in the wall and the mounting element.

7. A cap according to claim 1, wherein the mounting element at least partially comprises an elastomeric material chosen from thermoplastic elastomers and crosslinked elastomers.

8. A cap according to claim 7, wherein the material is chosen from nitrites, butyls, silicones, natural or synthetic latices, EPDMs, polyurethanes, blends of polypropylene and SBS, SEBS or EPDM, very low-density polyethylenes, blends based on polyester glycols (TPUs) or on polyether glycols (PEBA and COPE), and flexible polyvinyl chlorides (PVCS).

9. A cap according to claim 4, further comprising an interior seat formed around at least a part of the opening in the wall, wherein the cap is configured so that when vacuum pressure within the container is below a predetermined value, the sealing member is in sealed contact with the interior seat.

10. A cap according to claim 9, wherein the cap is configured so that the sealing member moves away from the interior seat when the vacuum pressure within the container reaches the predetermined value, so as to allow air to be taken into the container, and wherein the cap is further configured to return the sealing member to its position in sealed contact with the interior seat when the vacuum pressure within the container drops back below the predetermined value.

11. A cap according to claim 4, wherein the mounting element comprises an annular portion having a maximum diameter greater than the smallest diameter of the opening in the wall, wherein the annular portion retains the mounting element within the opening and forms the dispensing orifice.

12. A cap according to claim 11, wherein the mounting element comprises an intermediate portion formed between the annular portion and the sealing member, the intermediate portion being in flow communication with said dispensing orifice and passing through the opening in the wall so as to extend over at least part of its axial height within a container when the cap is on a container.

13. A cap according to claim 12, wherein the sealing member is formed by a skirt of the mounting element turned back on the intermediate portion, the turned-back skirt being forced elastically so that a sealing zone of the skirt is in sealed contact with an interior seat when vacuum pressure within the container is below predetermined value.

14. A cap according to claim 13, wherein the sealing zone is a zone of the turned-back skirt located away from a free edge of said turned-back skirt.

15. A cap according to claim 14, wherein the cap comprises a wall including a rim defining the interior seat.

16. A cap according to claim 13, wherein the sealing zone includes a lip formed by a free edge of the turned-back skirt.

17. A cap according to claim 13, wherein the turned-back skirt is turned back about a folding zone defined by an annular groove formed between the intermediate portion and the turned-back skirt on an interior surface of the mounting element.

18. A cap according to claim 17, wherein the annular groove is substantially V-shaped.

19. A cap according to claim 17, wherein the annular groove is substantially U-shaped.

20. A cap according to claim 2, wherein the movable member is held between a first stop formed by the seat and a second stop formed by the mounting element, a catch portion of the movable member being in elastic engagement with the second stop.

21. A cap according to claim 20, wherein the second stop includes a free edge of an axial skirt formed by the mounting element, the free edge of the axial skirt, in the absence of raised pressure within the container, being forced into elastic engagement with the catch portion of the movable member so as to press the valving portion of the movable member in sealed fashion on the seat.

22. A cap according to claim 21, wherein the catch portion of the movable member is formed of a ring arranged at an end of the movable member opposite to the valving portion and is secured to the movable member via a number of uniformly spaced radial tabs, an interior edge of the ring defining, in cooperation with the tabs, a number of passages for product to pass through when moving toward the dispensing orifice.

23. A cap according to claim 20, wherein the second stop includes an annular ring of the mounting element encircling a portion of the movable member, the catch portion of the movable member being configured to elastically engage the second stop so as to force the valving portion of the movable member to press in sealed fashion on the seat.

24. A cap according to claim 23, wherein the annular ring of the mounting element is connected to an intermediate portion of the mounting element by a number of uniformly spaced radial tabs so as to define a number of passages for product to pass through when moving toward the dispensing orifice.

25. A cap according to claim 2, wherein the valving portion of the movable member has an exterior surface configured to be aligned with or set back from an exterior surface of a wall of the cap when the valving portion of the movable member is pressed in sealed fashion on the seat.

26. A cap according to claim 4, wherein the opening includes a first portion extending over part of a thickness of the wall, and a second portion extending over the remainder of the thickness of the wall, the first portion having a first diameter and the second portion having a second diameter smaller than the first diameter, wherein the sealing member has a minimum diameter greater than the second diameter.

27. A cap according to claim 26, wherein the first portion is separated from the second portion by a shoulder portion configured to engage a shoulder formed by said mounting element, and wherein at least one groove is formed on at least one of the shoulder portion and the shoulder so as to form the at least one air intake passage.

28. A cap according to claim 27, wherein the at least one groove is continued axially on a lateral edge of the first and second portions.

29. A cap according to claim 1, further comprising a lid capable of removably covering the dispensing orifice.

30. A cap according to claim 29, wherein the lid is connected to a remainder of the cap by a hinge.

31. A cap according to claim 1, further comprising a connector configured to allow the cap to be fixed on a container.

32. A cap according to claim 31, wherein the connector is one of a snap-fastener and a screw-fastener.

33. A cap according to claim 1, wherein said movable member is formed of a thermoplastic material which is not elastically deformable.

34. A cap according to claim 33, wherein the thermoplastic material is chosen from polyethylene and polypropylene.

35. A cap according to claim 1, wherein the cap comprises a molded thermoplastic material.

36. A cap according to claim 35, wherein the thermoplastic material is chosen from polyethylene, polypropylene and polyvinyl chloride.

37. A dispenser for a product, comprising:

a container body; and the dispensing cap of claim 1 on the container body.

38. A dispenser according to claim 37, wherein one end of the container body is closed and another end of the container body includes a neck having a free edge defining an opening, wherein the cap is mounted on the neck of the container body, and the body of the container includes at least one elastically deformable wall.

39. A dispenser according to claim 38, wherein pressure applied to the deformable wall causes raised pressure within the container capable of forcing the valving portion of the movable member of the cap to move away from a seat and to allow product to leave through said dispensing orifice.

40. A dispenser according to claim 37, further comprising a cosmetic product in the container body.

41. A dispenser according to claim 37, further comprising product in the container body, the product being chosen from a hair-care product, a shampoo, a body-care product, a skin-care product, a makeup product, and a sun-protection product.

42. A method of dispensing a product, comprising:

providing the dispenser according to claim 37, wherein the container body contains a product;

increasing pressure inside the container body to cause the valving portion of the movable member to open the dispensing orifice; and dispensing the product through the dispensing orifice.

43. A method according to claim 42, wherein the increasing pressure includes deforming at least one wall of the container body.

44. A method according to claim 42, further comprising:

decreasing pressure inside the container body; and moving the sealing member to open the at least one air intake passage to permit flow of air into the container.

45. A method according to claim 44, wherein the sealing member moves in response to the decreasing pressure.

46. A method according to claim 42, wherein the product comprises a cosmetic product and the method further comprises applying the product to at least one of hair and skin.

47. A method according to claim 42, wherein the product is chosen from a hair-care product, a body-care product, a skin-care product, a makeup product and a sun-protection product, and wherein the method further comprises applying the product to at least one of hair and skin.

* * * * *

UNITED STATES PATENT AND TRADEMARK OFFICE

CERTIFICATE OF CORRECTION

PATENT NO. : 6,581,808 B2
DATED : June 24, 2003
INVENTOR(S) : Vincent De Laforcade It is certified that error appears in the above-identified patent and that said Letters Patent is hereby corrected as shown below:

Column 12,
Line 9, “nitrites,” should read -- nitriles, --.

Signed and Sealed this

Ninth Day of September, 2003

JAMES E. ROGAN
*Director of the United States Patent and Trademark Office*